US005286243A

United States Patent [19]

Lapcevic

[11] Patent Number: 5,286,243

[45] Date of Patent: * Feb. 15, 1994

[54] EXERCISE DEVICE HAVING A VARIABLE RESISTANCE CURVE

[76] Inventor: Thomas G. Lapcevic, 1411 Grandview Ave., Pittsburgh, Pa. 15211

[ * ] Notice: The portion of the term of this patent subsequent to Aug. 13, 2008 has been disclaimed.

[21] Appl. No.: 713,746

[22] Filed: Jun. 11, 1991

Related U.S. Application Data

[63] Continuation-in-part of Ser. No. 464,231, Jan. 12, 1990, Pat. No. 5,039,089.

[51] Int. Cl.[5] ..... A63B 21/06

[52] U.S. Cl. ..... 482/97; 482/100; 482/137; 482/908

[58] Field of Search ..... 482/93, 97, 98, 99, 482/100, 101, 102, 103, 140, 908, 94, 133–138

[56] References Cited

U.S. PATENT DOCUMENTS

| | | | |
|---|---|---|---|
| 684,688 | 10/1901 | Herz | 482/97 |
| 2,855,199 | 10/1958 | Noland et al. | 482/97 |
| 3,306,611 | 2/1967 | Gaul | 482/100 X |
| 4,405,128 | 9/1983 | Mclaughlin et al. | 482/97 |
| 4,627,614 | 12/1986 | de Angeli | 482/97 |
| 4,711,448 | 12/1987 | Minkow et al. | 482/100 |
| 4,854,578 | 8/1989 | Fulks | 482/97 X |
| 4,863,161 | 9/1989 | Telle | 482/97 |
| 4,982,955 | 1/1991 | Heasley | 482/100 |
| 5,039,089 | 8/1991 | Lapcevic | 482/97 |

FOREIGN PATENT DOCUMENTS

| | | | |
|---|---|---|---|
| 3445104 | 6/1986 | Fed. Rep. of Germany | 482/100 |

*Primary Examiner*—Robert Bahr

*Attorney, Agent, or Firm*—Reed Smith Shaw & McClay

[57] ABSTRACT

A variable resistance exercise device is provided which enables a user to select from an almost limitless set of resistance curves having various shapes and amplitudes. These results are achieved using a fixed baseline resistance and a variable resistance generated by a torque arm assembly. Preferably, the torque arm assembly either has a vertical diametric torque arm and two horizontal radial torque arms which are perpendicular to the vertical torque arm or two diametric torque arms which are perpendicular to each other. By varying the position of a weight member on each of these arms, as well as the ratio of the net horizontal torque and the vertical torque generated by the weight members, the baseline resistance force that the user experiences can be infinitely varied. Additionally, through the use of a gear assembly, the user can achieve a force variance during the exercise which is greater than the minimum force experienced during the exercise.

55 Claims, 8 Drawing Sheets

EXERCISE DEVICE HAVING A VARIABLE RESISTANCE CURVE

This application is a continuation-in-part of application Ser. No. 07/464,231, filed Jan. 12, 1990, now U.S. Pat. No. 5,039,089.

FIELD OF THE INVENTION

The present invention relates to exercise devices used on the human body and more particularly to exercise devices wherein the resistance curve experienced by the human body can be selectively and easily adjusted.

BACKGROUND OF THE INVENTION

There are many different types and kinds of exercise machines as a review of the issued U.S. patents can attest. Most of these devices are designed to provide either a constant resistance throughout the exercise motion or a variable resistance that varies according to a fixed resistance curve. The resistance curve is fixed for each of these exercise devices and the shape of the resistance curve cannot be varied. Such devices are disclosed in U.S. Pat. Nos.: 4,799,670; 4,666,149; 4,635,933; 4,502,681; 4,500,089; 4,494,751; 4,405,128; and 2,855,199.

The disadvantages with these exercise devices are particularly apparent in U.S. Pat. Nos.: 4,836,536; 4,709,920; and 4,711,448. In U.S. Pat. Nos. 4,836,536 and 4,711,448 the resistance experienced by the user is constant throughout the range of motion of the exercise. Consequently, the resistance curve for each of these devices is fixed and cannot be changed. In U.S. Pat. No. 4,709,920, the resistance experienced by the user varies throughout the range of motion of the exercise due to the use of a cam path which has a varying radius. The resistance curve for this device, however, is fixed due to the shape of the particular cam path chosen. While the cam path and thus the resistance curve, can be varied somewhat by shifting the orientation of the intermediate support using holes and locking pins, one can only select between a limited number of cam paths and thus a limited number of resistance curves. Moreover, due to the preset arrangement of the holes and the intermediate support, the number of cam paths and thus the number of resistance curves to choose from is limited for any given embodiment of this device. Only by changing the intermediate support or using a different arrangement of holes can a wider range of resistance curves be implemented.

Most existing exercise devices provide but a single resistance curve that cannot be altered. Some, however, enable the resistance curve to be varied, but the choice of resistance curves is very limited. As a result, the muscular growth of the users of such devices is limited. Moreover, the inability of these exercise devices to adapt their resistance curves to the specific needs of the individuals using them causes them to be inadequate in many situations, especially where the needs of the various individual users differ significantly. These situations arise frequently in training or with injured individuals undergoing physical rehabilitation where it is desirable to provide a wide range of different resistance curves that easily can be adjusted to meet the specific needs of any individual.

It would be desirable therefore, to develop an exercise device which overcomes the problems of the present devices and provides not only a variable resistance but also a plurality of resistance curves which may be selectively chosen and easily adjusted by the user to meet his specific needs.

SUMMARY OF THE INVENTION

Generally, the present invention provides an exercise device in which the maximum and minimum segments of resistance may be varied and provided at selected regions of the exercise motion. The present invention utilizes a unique torque assembly having a plurality of weights such that the net resulting torque from the weights can be positioned in any direction between 0° and 360° thereby providing the user with a wide range of different resistance curves from which to choose. The present invention builds upon the disclosures of my copending application Ser. No. 07/332,836 filed Apr. 3, 1989 and Ser. No. 07/269,517 filed Nov. 10, 1988, the disclosures of which are incorporated herein by reference.

Preferably the exercise device described herein comprises a free standing support frame having interconnected vertical and horizontal framework members. A weight support carriage is supported within the support frame for vertical movement along guide bars. The weight support carriage includes a plunger bar for detachably supporting weight members. In addition, a first shaft is rotatably attached to the frame, and an exercise bearing member to which the user applies the exercise force is secured to the first shaft by a bracket.

Attached to the first shaft is a first spur gear. The first spur gear engages a second spur gear which is attached to a second shaft rotatably mounted on the frame. Specific gear ratios are chosen so that the maximum degree of rotation applied to the first shaft by the exercise motion of the user is converted to 180° of rotation on the second shaft.

A fastening means is provided for attaching a torque arm assembly to one end of the second shaft. Preferably, as shown in FIGS. 1*a* and 1*b*, the torque arm assembly comprises a diametric torque arm and two radial torque arms wherein the diametric torque arm runs vertically and is mounted at its midpoint on the second shaft. The two radial torque arms are perpendicular to the diametric torque arm and are secured on opposite sides to the midpoint of the diametric torque arm. As a result of this configuration, the center of the second shaft is the concentric center for each torque arm. Alternatively, the two radial torque arms could be replaced by a second diametric torque arm which was offset from the first diametric torque arm so that the weights could move freely on each torque arm.

A weight member is supported on each torque arm and is linearly positionable along each torque arm. Preferably, the weight members on the radial torque arms have the same value which may or may not be the same value as the weight member on the diametric torque arm. A pressure lock is provided so that the weight members may be positioned along and secured to the torque arms. Although the preferred embodiment of three torque arms has been described, it is evident that a torque assembly having more than three torque arms could be used thereby providing for a more precise setting of each resistance curve. Similarly, the present invention can be practiced with a torque arm assembly having 3 radial torque arms instead of a diametric torque arm and two radial torque arms. Preferably, the 3 radial torque arms would each be 120° apart, as shown in FIG. 2, and have the same size weight members linearly positionable along their length.

A cable wheel having a circular arc is secured to the second shaft. A cable guide is fixed to the support frame. A length of cable is secured at one end to the weight support carriage and at its other end to the cable wheel while the cable is reeved about the cable guide means.

In the operation of the present invention, the weight support carriage provides a constant resistance force as the user performs an exercise motion. This is the baseline resistance force. Different baselines can be chosen by using different amounts of weight from the weight support carriage. Each weight supported on the torque arms of the torque assembly can be positioned to provide a resistance force which follows a sinusoidal curve which is combined with the constant resistance force generated by the weight support carriage. Thus, the torque assembly permits the user to vary the magnitude of the overall resistance force at selective positions of the exercise motion through the relative placement of the weight members on the torque arms. By choosing the correct combination of the sinusoidal curves of each torque arm weight, almost any shape of resistance curve can be generated by the torque assembly. When this feature is combined with the baseline resistance force, the result is an exercise device having a very wide range of easily adjustable resistance curves from which the user can choose.

The user is even able to eliminate the overall or net effect of the torque assembly by selectively balancing the weight members. For example, if the weight member on the vertical diametric torque arm is positioned at its concentric center and if the weight members on the horizontal radial torque arms are of equal weight and positioned an equal distance from their concentric center (in equilibrium, such as shown in FIG. 1*a*), the user will experience a constant resistance throughout the exercise motion. If 50 pounds of weight is selected from the weight support carriage, the user will work against a constant baseline value of 50 pounds of force from beginning to end of the exercise motion.

Now suppose that the second shaft and the torque arm assembly rotate in a clockwise direction as the exercise is performed. If the weight member on the vertical diametric torque arm remains at the concentric center and the weight members on the horizontal radial torque arms are unbalanced to the left, the user will experience a greater resistance during the beginning of the exercise motion and a lesser resistance at the end of the exercise motion. Conversely, should the weight members on the horizontal radial torque arms be unbalanced to the right, the user will experience a lesser resistance during the beginning of the exercise motion and a greater resistance at the end of the exercise motion.

Still assuming a clockwise rotation of the torque arm assembly, if the weight member on the vertical diametric torque arm is moved away from its concentric center toward the twelve o'clock position and the weight members on the horizontal radial torque arms are placed in their equilibrium positions, the user will experience lesser resistance during the middle portion of the exercise motion and greater resistance during the beginning and ending portions of the exercise motion. Conversely, should the weight member on the vertical diametric torque arm be moved past its concentric center and positioned toward the six o'clock position (again assuming that the weight members on the horizontal radial torque arms are in their equilibrium positions), the user will experience greater resistance during the middle portion of the exercise motion and lesser resistance during the beginning and ending portions of the exercise motion.

It should be appreciated by those skilled in the art of forces that by combining the effects of the weight members on the vertical diametric torque arm and the horizontal radial torque arms, the vector sum of the independent sinusoidal forces generated by each torque arm can create an indefinite number of resultant resistant forces thereby enabling the user to select from an unlimited number of different resistance curves. Not only can the shape of the resistance curve be varied with the present device, but also the amplitude. For example, if the weight member on the vertical diametric torque arm is positioned toward the twelve o'clock position and the weight members on the horizontal radial torque arms are unbalanced to the right (i.e. toward the three o'clock position) to generate a potential resistance force equal to that of the vertical diametric torque arm, the user will experience the minimum amount of resistance at the point in the exercise motion which corresponds to a 45° rotation of the second shaft.

It would be apparent to one skilled in the art of forces that by varying the relative forces generated by the torque arms of the torque assembly, an infinite set of resistance curves or resistance patterns are available to the user which can be selectively positioned and intensified. Moreover, if the ratio between the torque generated by the radial torque arms and the torque generated by the vertical torque arm is kept constant, the resistance curve experienced by the user will be fixed. A displacement of the weights along the torque arms while keeping the torque ratio constant will only change the amplitude of the resistance curve. If, however, the torque ratio is changed, this will result in a change in the shape of the resistance curve thereby generating a new resistance curve.

The use of the gear assembly in the present device provides additional flexibility. As discussed above, each weight in the torque arm assembly produces a resistance force which is sinusoidal in nature. Since the sine curve is an oscillating function with a frequency of 360°, the full extent of the intended objectives of the present invention can be achieved when the exercise motion is matched to one half of that cycle (i.e., 180°).

Often it is desired to have the user exercise against a resistance force in which the maximum or minimum resistance is experienced during the middle portion of the exercise motion with the force variance exceeding the force experienced at either the beginning or end of the exercise motion. For example, it may be desired for the user to experience 20 ft-lbs of resistance at the beginning of the exercise motion, 50 ft-lbs of resistance in the middle of the exercise motion and 20 ft-lbs of resistance at the end of the exercise motion. Let us further assume a 90° range of exercise motion.

The desired result can be achieved using the present invention if a gear assembly is used to convert the degree of rotation on the user shaft to 180° on the torque arm assembly shaft. The user would select 20 ft-lbs of constant resistance from the vertical weight stack, balance the horizontal radial torque arms and position the weight member on the vertical diametric torque arm below its concentric center toward the six o'clock position so that the weight member would have a maximum effect of 15 ft-lbs on the torque arm assembly shaft, as shown in FIG. 1*a*. FIG. 3*a* shows the beginning, middle and end positions of the vertical diametric torque arm of FIG. 1*a* during the exercise motion and FIG. 3*b* shows the resistance curve experienced by the user. As the user performs the exercise motion, the user will initially experience only the 20 ft-lbs of constant force provided by the vertical weight stack, however, as the user approaches the middle of the exercise motion, the user experiences 30 ft-lbs of additional resistance as the diametric torque arm approaches the nine o'clock position. The effect of this weight member is doubled due to the mechanical disadvantage created by the 2:1 gear ratio. As the user completes the second half of the exercise motion, the effective torque generated by the vertical torque arm will again approach zero as the diametric torque arm approaches the twelve o'clock position and the user will again experience only the constant 20 ft-lbs of resistance provided by the vertical weight stack.

In order for the present invention to achieve a 30 ft-lb variance in the middle of the exercise motion when a gear assembly is not used, a weight member providing a 72.4 ft-lb maximum torque effect on the shaft engaged by the user would need to be positioned on the vertical diametric torque arm below the concentric center toward the six o'clock position. In addition, the horizontal radial torque arms would have to be unbalanced to the left (i.e. toward the nine o'clock position) with an initial torque effect on the torque arm assembly shaft equal to 72.4 ft-lbs as shown in FIG. 4*b*. FIG. 4*a* shows the beginning, middle and end positions through which one of the horizontal torque arms and the vertical torque arm of FIG. 1*b* will move. This setting will result in the exerciser experiencing 102.4 ft-lbs of resistance from the combined torque effect of the weight members on the horizontal and vertical torque arms (assuming that no constant weight is provided by the vertical weight stack) when the user is halfway or 45 degrees into the first half of his exercise motion. This is shown in FIG. 4*b* which shows the resistance curve experienced by the user. Even assuming that no constant resistance is provided from the vertical weight stack, the exerciser must overcome at least 72.4 ft-lbs of torque force at the beginning and end of the exercise motion when it is desired to have a 30 ft-lb increase in the middle portion of the exercise motion.

As shown previously, without the gear assembly, a user will experience 70.7% of the maximal torque effect of the weight members on the respective torque arms at the beginning and end of the exercise motion when maximum or minimum resistance is placed in the middle of the exercise motion. This provides for a variance of only 29.3%. The effective variance provided by the weight members on the respective torque arms when a gear assembly is used, however, is 100% providing the user with a much greater flexibility.

Other details, objects and advantages of the present invention will become apparent as the following description of the presently preferred embodiments of practicing the invention proceeds.

BRIEF DESCRIPTION OF THE DRAWINGS

In the accompanying drawings, preferred embodiments of the invention are illustrated in which.

DETAILED DESCRIPTION OF THE PREFERRED EMBODIMENTS

Figure 1A:
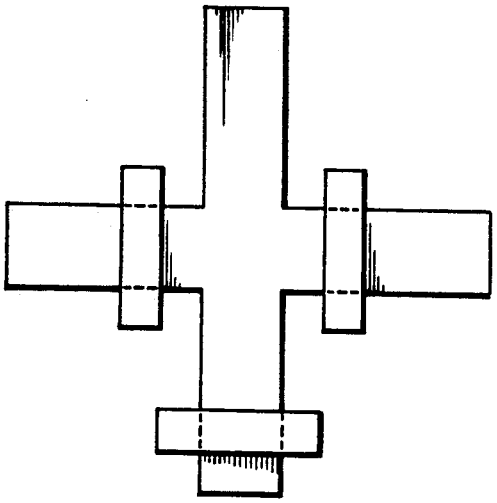
FIG. 1*a* shows a torque assembly comprising a vertical diametric torque arm and two horizontal torque arms with the horizontal torque arms being balanced.
Figure 1B:
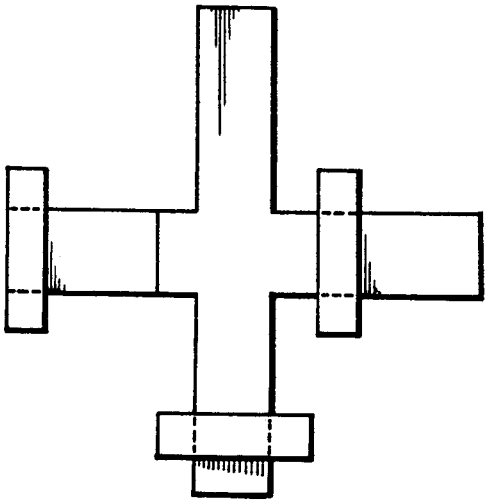
FIG. 1*b* shows a torque assembly comprising a vertical diametric torque arm and two horizontal torque arms with the horizontal torque arms being unbalanced.
Figure 2:
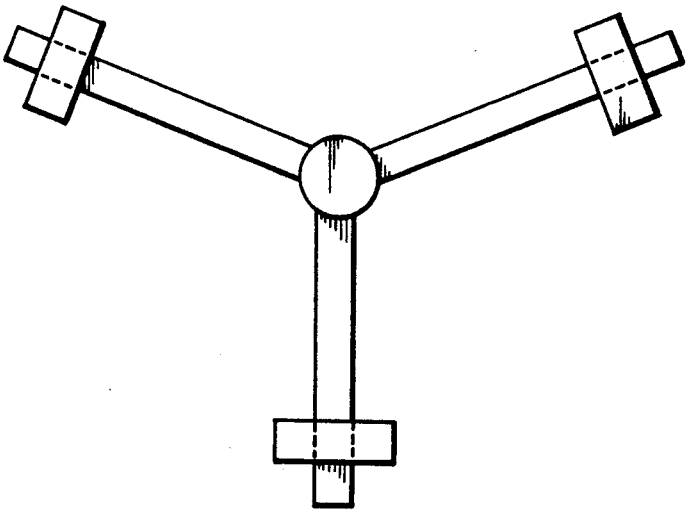
FIG. 2 shows a torque assembly comprising three radial torque arms each separated by 120°.

Referring now to the drawings wherein preferred embodiments of the present invention are shown for illustrative purposes only and not for purposes of limiting the same, FIGS. 5–9 show a weight lifting exercise device 10 having an exercise station 12 which may be occupied by a user. The exercise device 10 includes a main frame 14 which includes a base 16 consisting of lateral base frame members 18 and longitudinal frame members 20 suitable for support on a floor surface. The frame 14 also includes parallel forward and rear vertical frame members 22 and 24, respectively, which support an upper longitudinal frame member 26. Disposed within the frame 14 is a weight support carriage 28 which includes a plunger bar 30 having apertures along its length for receiving a pin 32 which may be disposed beneath a selected number of weight plates 34 in a known manner to establish a baseline resistance force. The vertical movement of weight plates 34 is guided by vertical guide bars 35. The upper end of the plunger bar 30 is connected to one end of a length of cable, shown as 36, which is reeved about first and second pulleys, 38 and 40, respectively, which are rotatably mounted on upper frame member 26.

The frame 14 also includes a foremost vertical frame member 44 which may support the leading end of a first bar member 46 of exercise station 12 in a predetermined orientation. A second bar member 48 is preferably attached to the front vertical frame member 22 parallel to the first bar member 46. The first bar member 46 supports a first pillow block bearing 50 or similar type bearing means. Additionally, the second bar member 48 supports a second pillow block bearing 52 or other similar type bearing. Rotatably supported by first pillow block bearing 50 and second pillow block bearing 52 is a horizontal first rotatable shaft 54. Radially attached to first rotatable shaft 54 is a bracket 56 which supports a bearing member 58 which is engaged by the user during the exercise motion and whose position may be varied along bracket 56 by means of a pop pin 59 which may engage apertures 57 in bracket 58. For example, bearing member 58 may comprise a horizontal padded cylindrical member which is engaged by a user for rotation about the shaft 54 in what is typically referred to as a leg extension exercise. A first spur gear 67 is attached to said first rotatable shaft 54 outboard the second pillow block bearing 52.

A third bar member 60 is mounted on bracket 61 which is attached to vertical frame member 22. The third bar member 60 supports a third pillow block bearing 62 and a fourth pillow block bearing 63. Rotatably supported by third pillow block bearing 62 and fourth pillow block bearing 63 is a second rotatable shaft 66. A second spur gear 68 is attached to shaft 66 outboard the fourth pillow block bearing 63 and engages the first spur gear 67. Also radially attached to shaft 66 is a cable wheel 64 which consists of a circular arc member having a groove about its circumferential surface. The other end of cable 36 is attached to one end of cable wheel 64 by an attachment bolt 65 in order that the cable 36 may be taken up along the groove when the cable wheel 64 is rotated during the exercise motion. Torque arm assembly 70 is attached to shaft 66 outboard the second spur gear 68.

Torque arm assembly 70 preferably contains at least a first diametric torque arm 72 which is attached at its midpoint to the outboard end of second shaft 66. Flanges 71 and 73 are attached perpendicular to and at the ends of diametric torque arm 72 extending outward from gear assembly 67 and 68. A first weight support rod 74 is attached at its ends to the outboard side of flanges 71 and 73. A second weight support rod 75 is attached at its ends to the inboard side of flanges 71 and 73. Weight member 76 is supported on diametric torque arm 72 by weight support rods 74 and 75. Pressure locking device 77 is provided so that weight member 76 may be positioned along weight support rods 74 and 75 and secured to weight support rod 74.

Torque arm assembly 70 preferably contains a first radial torque arm 79 which is attached at a right angle at the midpoint of diametric torque arm 72 and extends radially toward three o'clock. Flange 78 is attached perpendicular to and at the end of radial torque arm 79 extending outward from gear assembly 67 and 68. Flange 80 is attached perpendicular to and along radial torque arm 79 allowing space for weight member 76 to travel along weight support rods 74 and 75. A first weight support rod 81 is attached at its ends to the outboard side of flanges 78 and 80. A second weight support rod 82 is attached at its ends to the inboard side of flanges 78 and 80. A first horizontal weight member 83 is supported on radial torque arm 79 by weight support rods 81 and 82. Pressure locking device 84 is provided so that weight member 83 may be positioned along weight support rods 81 and 82 and secured to weight support rod 81.

Torque arm assembly 70 preferably also contains a second radial torque arm 86 which is attached at a right angle at the midpoint of diametric torque arm 72 and extends radially toward nine o'clock. Flange 85 is attached perpendicular to and at the end of radial torque arm 86 extending outward from gear assembly 67 and 68. Flange 87 is attached perpendicular to and along radial torque arm 86 allowing space for weight member 76 to travel along weight support rods 74 and 75. A first weight support rod 88 is attached at its ends to the outboard side of flanges 85 and 87. A second weight support rod 89 is attached at its ends to the inboard side of flanges 85 and 87. A second horizontal weight member 90 is supported on radial torque arm 86 by weight support rods 88 and 89. Pressure locking device 91 is provided so that weight member 90 may be positioned along weight support rods 88 and 89 and secured to weight support rod 88.

It should of course be realized that the preferred embodiment described above can be rearranged and adapted within the scope of the present invention. Although the beneficial aspects of gears 67 and 68 have been made apparent in the previous description of the gear assembly, it is possible for the torque arm assembly to be attached to the first shaft 54 instead of the second shaft 66. Additionally, although the use of gears 67 and 68 may be preferred for the device disclosed herein, it should be appreciated that other known mechanical devices for changing mechanical ratios may also be used in the present invention to accomplish similar results. One example of such, by way of illustration, may be through the use of opposite winding cables attached to cable wheels.

Further, it should be appreciated that if desired, the torque arm assembly could have more than one diametric torque arm, as will be described hereinbelow, and more than two radial torque arms attached concentrically to shaft 54 or 66 and positioned at predetermined angular positions each with linearly positionable weight members. It is also possible to use one or more additional torque arm assemblies on different shafts geared to different degrees of rotation.

Further, the resistance provided by the constant vertical weight plates 34 and the weight members on the respective torque arms can be accomplished through other forms of resistance. For example, the constant resistance provided by the vertical weight plates could be provided through other forms of resistance currently used such as hydraulics. The weight members on the torque arms could be provided through the use of vertical weight stacks in which resistance is deflected through cables and pulleys to the respective torque arms. Of course, these alternative means are by way of illustration and not limitation. Moreover, the positionable means provided herein for the weight members supported on the respective torque arms could be accomplished by providing means, e.g., a series of pegs, to secure and detach different weight members along the lengths and/or at the ends of a series of torque arms mounted on the rotatable shaft at predetermined angular positions.

Further, it should be appreciated that the present invention can be used to achieve its desired effects within any resistance exercise device wherein the exercise motion can be converted to a rotating shaft. For example, when using an exercise device in which resistance is provided through a vertical weight support carriage with the resistance being transferred through pulleys, the cable attached at one end to the weight support carriage could be attached at the other end tangent to a first cable wheel mounted on a rotatable shaft. A second cable wheel can be mounted on the shaft with a second cable segment attached and wound around the second cable wheel on one end with the other end being transferred by cable guide means to a bearing member engaged by the user which can be linearly or rotatably displaced. The torque arm assembly could then be secured to the shaft and operated as disclosed herein. As the user displaces the bearing member, the second cable unwinds from the second cable wheel causing the first cable segment to reeve around the first cable wheel and lift the vertical weight support carriage. During the process the shaft and torque assembly rotate creating the potential for the torque assembly to achieve its desired results.

As here used, resistance force will be taken to mean that force which must be overcome by the user in completing the exercise motion. Hence, the resistance force will be that force which must be applied to bearing member 58 to rotate the first shaft 54. Accordingly, a positive moment force applied to shaft 54 will assist the user in displacing shaft 54 while a negative moment force will add to the resistance force. In one preferred embodiment, gears 67 and 68 cause shaft 66 and torque arm assembly 70 to rotate in the opposite direction of shaft 58. Additionally, assuming a 90° exercise motion and a 2:1 gear ratio which causes shaft 66 and therefore torque arm assembly 70 to rotate 180°, the weight members (76, 83, 90) supported on the torque arms (72, 79, 86) will have twice the torque effect on first shaft 54.

Figure 3A:
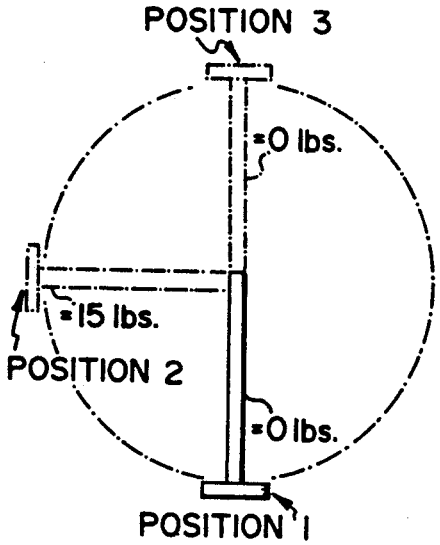
FIG. 3*a* shows the beginning, middle and end positions of the vertical diametric torque arm of FIG. 1*a* during an exercise motion.
Figure 3B:
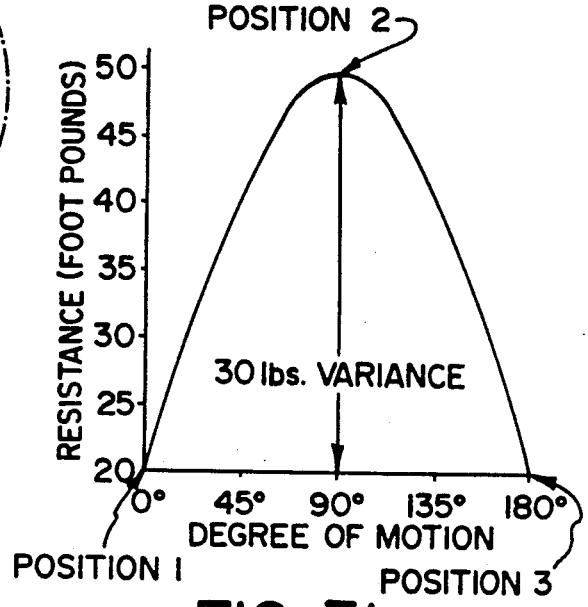
FIG. 3*b* shows the resistance curve of the torque arm of FIG. 3*a* with a 2:1 gear ratio and a 20 ft-lbs baseline weight.
Figure 4A:
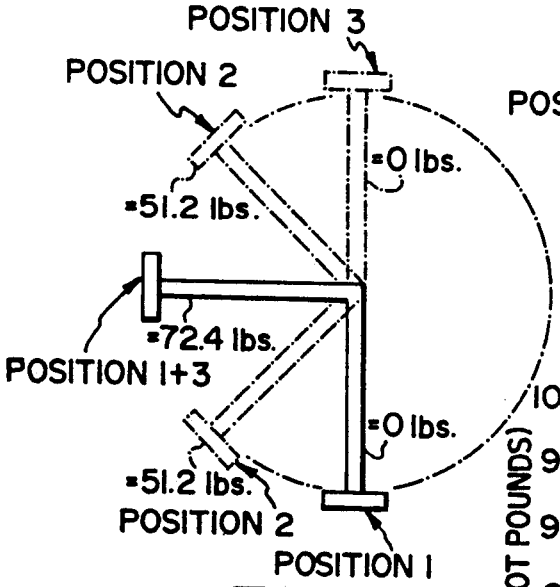
FIG. 4*a* shows the beginning, middle and end positions of the vertical diametric torque arm and one of the radial torque arms of FIG. 1*b* during an exercise motion.
Figure 4B:
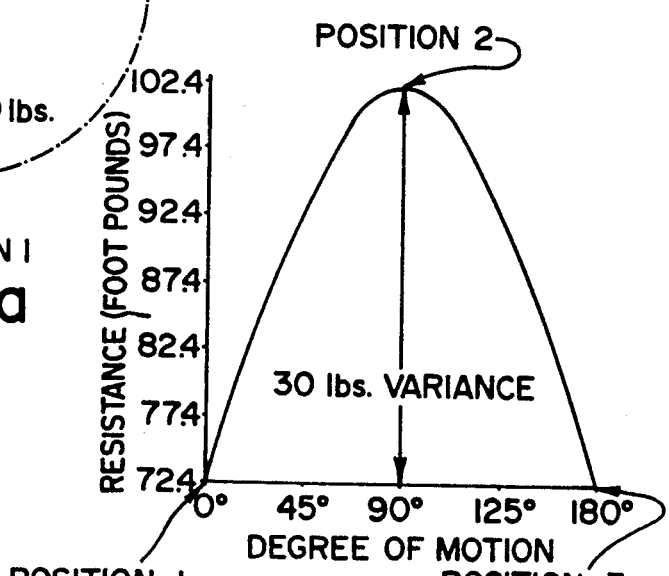
FIG. 4*b* shows the resistance curve generated by the torque arms of FIG. 4*a*.
Figure 5:
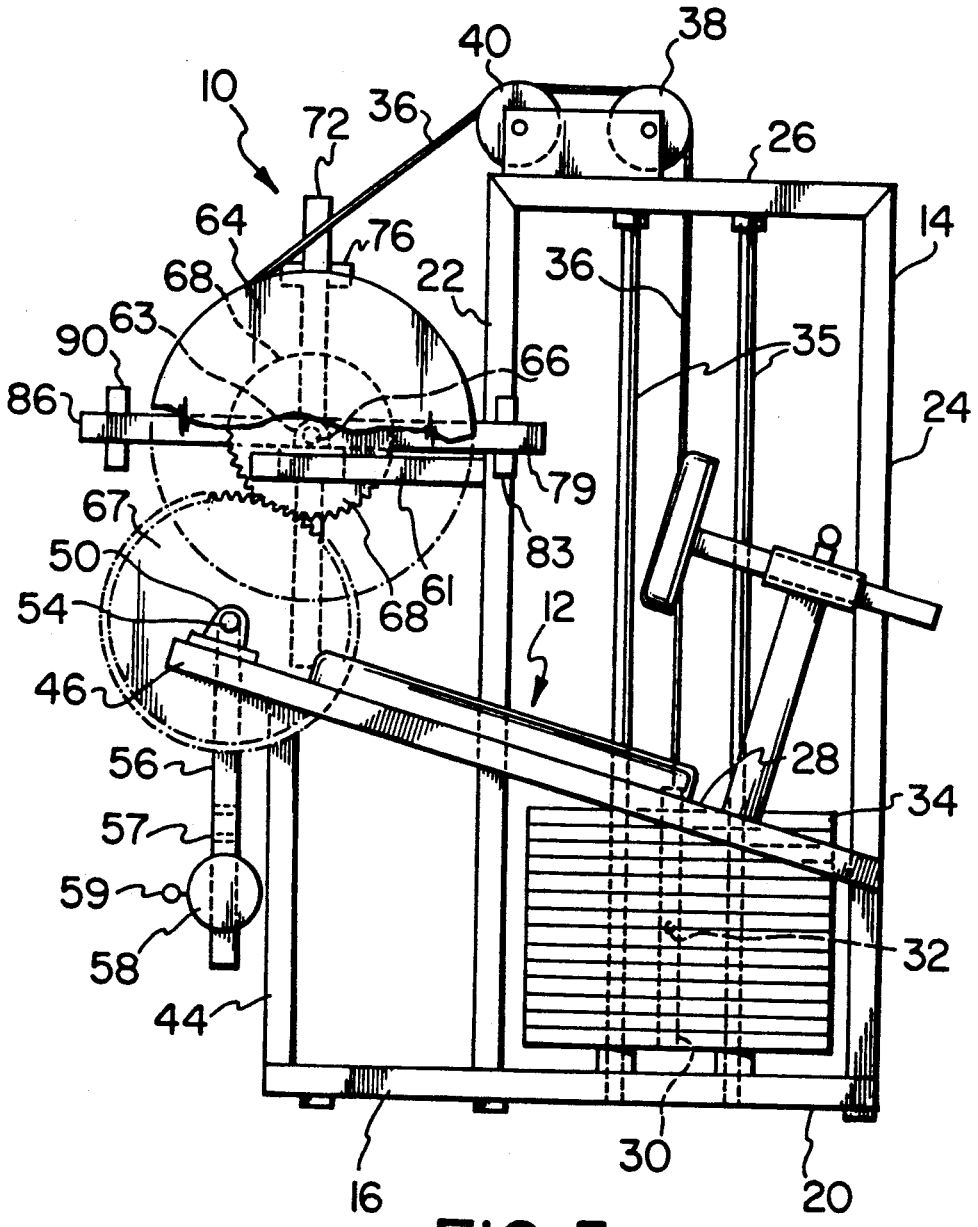
FIG. 5 is a side elevation view of the present invention.
Figure 6:
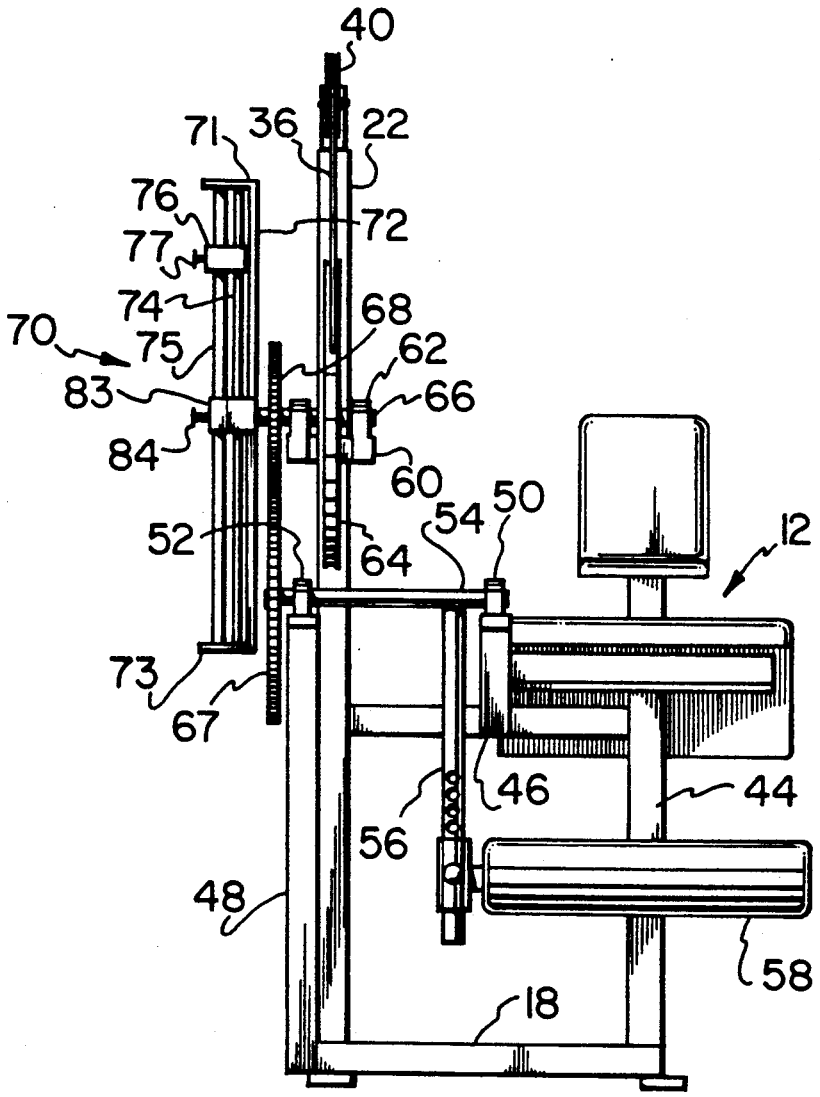
FIG. 6 is a front elevation view of the present invention.
Figure 7:
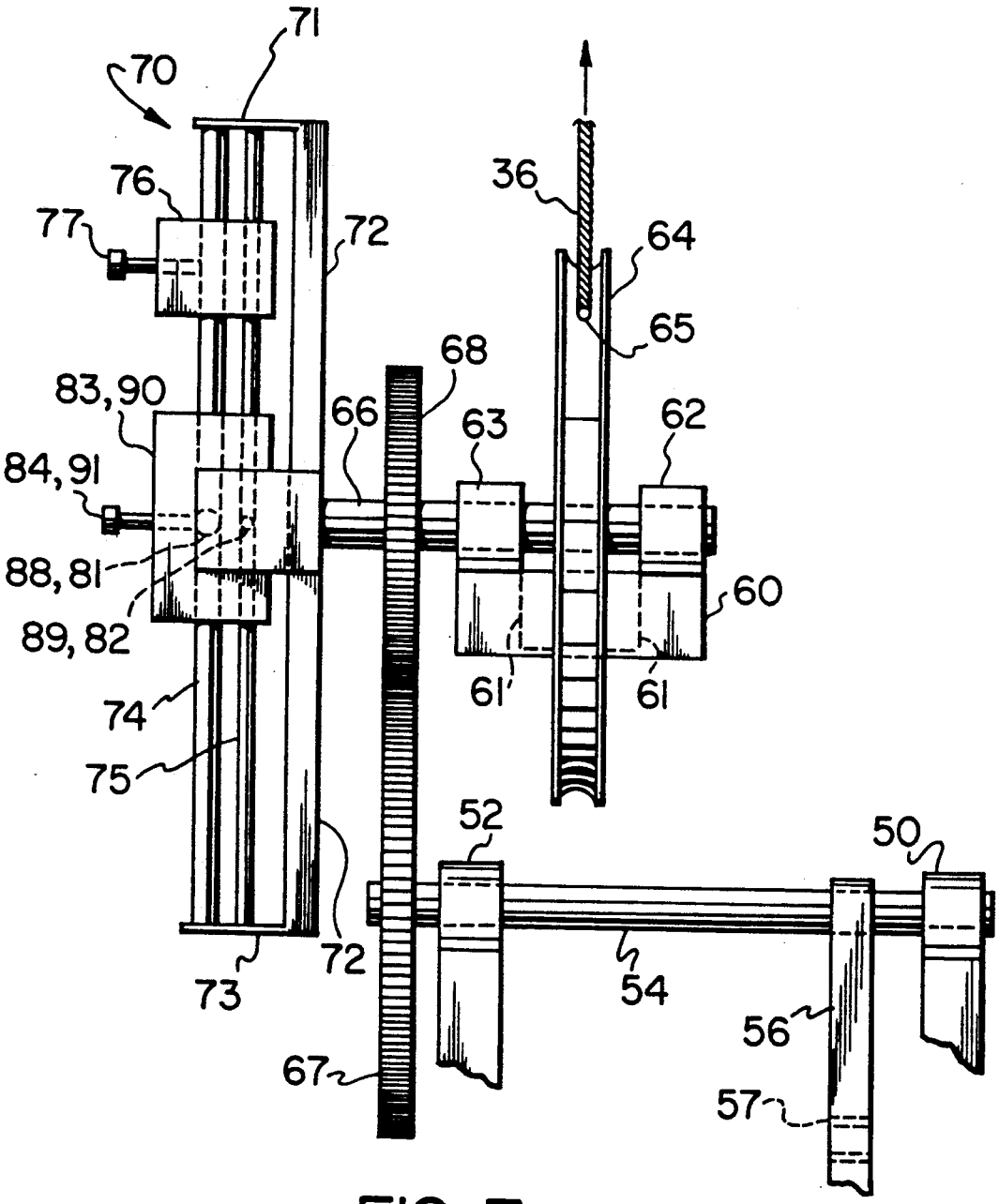
FIG. 7 is a close-up view of a portion of the components shown in FIG. 6.

Suppose that shaft 54 rotates in a counterclockwise direction causing shaft 66 and torque arm assembly 70 to rotate in a clockwise direction and that vertical weight member 76 weighs 20 lbs. and is secured to weight support rod 74 six inches above the concentric center (i.e., shaft 66) toward the 12 o'clock position. Assuming that weight members 79 and 86 are in equilibrium, torque arm assembly 70 will initially have no effect on the second shaft 66 and consequently no effect on first shaft 54. However, as the user rotates shaft 54 by means of engagement of bearing member 58, weight member 76 will provide a constantly decreasing sinusoidal force until it reaches its maximum effect at the 3 o'clock position. At the 3 o'clock position, weight member 76 will be providing 20 ft-lbs of assistance to the user in rotating shaft 54 and, consequently, in overcoming the constant resistance provided by weight plates 34 which is indirectly transferred to shaft 54 through cable 36, pulleys 38 and 40, cable wheel 64, shaft 66 and gear assembly 67 and 68. As the user continues through the remainder of the exercise motion, the assistance provided by weight member 76 will be constantly decreasing until it again provides no effect at the 6 o'clock position. Of course, positioning weight member 76 further away from its concentric center toward the 12 o'clock position will increase the amplitude of the sinusoidal effect of weight member 76. This is the opposite effect from that shown in FIGS. 3*a* and 3*b*.

As described above, horizontal weight members 83 and 90 may be similarly used to achieve maximal and minimal amounts of assistance and resistance to shaft 54. By selectively positioning weight members 83 and 90 along horizontal radial torque arms 79 and 86, the user can experience maximal resistance or assistance at either the beginning or end of the first half of the exercise motion. Additionally, by combining the effects of weight member 76 on the vertical diametric torque arm 72 and one of weight members 83 and 90 on radial torque arms 79 and 86 respectively, the user can experience an infinite number of resistance patterns or curves and selectively determine the resistance pattern or resistance curve that is best suited for the user's individual needs. This is accomplished by selectively determining the torque arms and the weight members necessary to have the desired torque effect (selecting direction of vertical and horizontal disequilibrium), by selecting the specific torque ratios among the vertical and horizontal torque arms (relative degree of vertical and horizontal disequilibrium), and by determining the amplitude of the desired torque effect (degree of disequilibrium on the effective torque arms).

Figure 9:
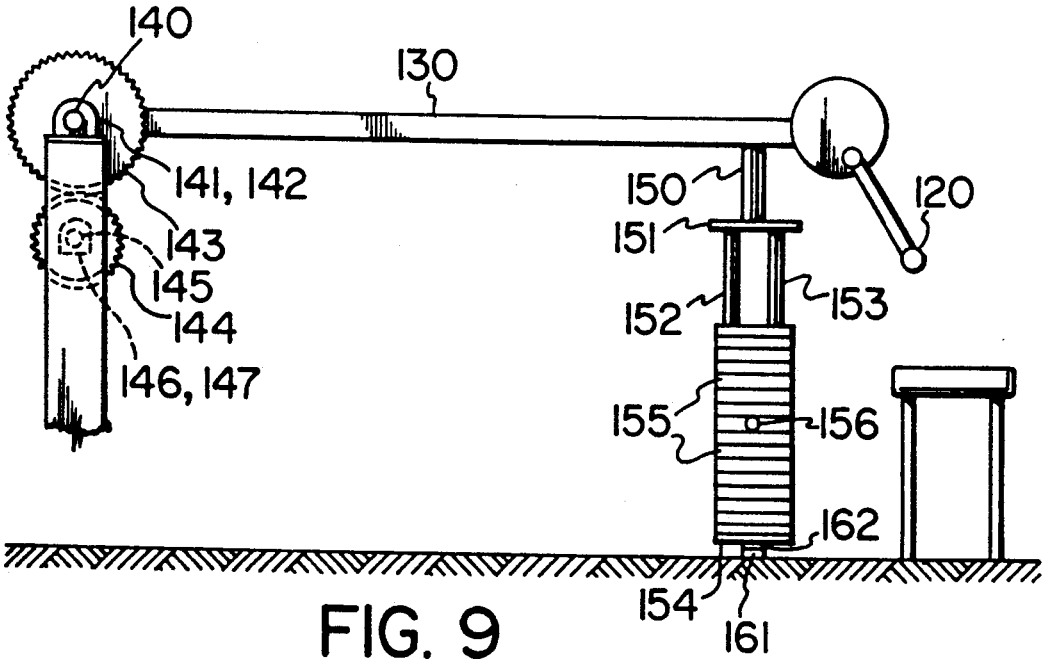
FIG. 9 is a side elevation of another embodiment of the present invention.

In another preferred embodiment, the resistance means is attached to the user interface member through a second class lever which can be accomplished with or without the use of cables or similar connecting devices. As shown in FIG. 9, which does not use cables, the rotational motion required by the torque arm assembly to achieve its underlying objectives is mechanically obtained from the fulcrum of the lever which is indicated by shaft 140. The user interface member 120 is attached to one end of a main lever beam 130. A plunger bar 150 is flexibly attached to the main lever beam 130 intermediate its ends. The plunger bar 150 passes through an upper guide rod plate 151 and is free to pass through weight stack 155. Guide rods 152 and 153 are attached at their end points to upper guide rod plate 151 and lower guide rod plate 154. The individual weight plates 155 are selected for use by pin 156 and are free to slide vertically on guide rods 152 and 153. Lower guide rod plate 154 is attached to main frame member 161 by a pivotal linkage 162 which permits the weight carriage to move fore and aft as the exercise motion may require.

The other end of the main lever beam 130 is attached to a rotatable first shaft 140. The first shaft 140 is rotatably mounted in pillow bloc bearings 141 and 142. First spur gear 143 is attached to one end of first shaft 140. A second spur gear 144 is mounted on second rotatable shaft 145. Second shaft 145 is supported from the main frame by pillow block bearings 146 and 147. Torque arm assembly 70 can now be mounted on second shaft 145. The rotational motion of first shaft 140 is converted to 180° of rotational motion on second shaft 145 by the two spur gears. The torque arm assembly 70 is then operated as described above.

Figure 10:
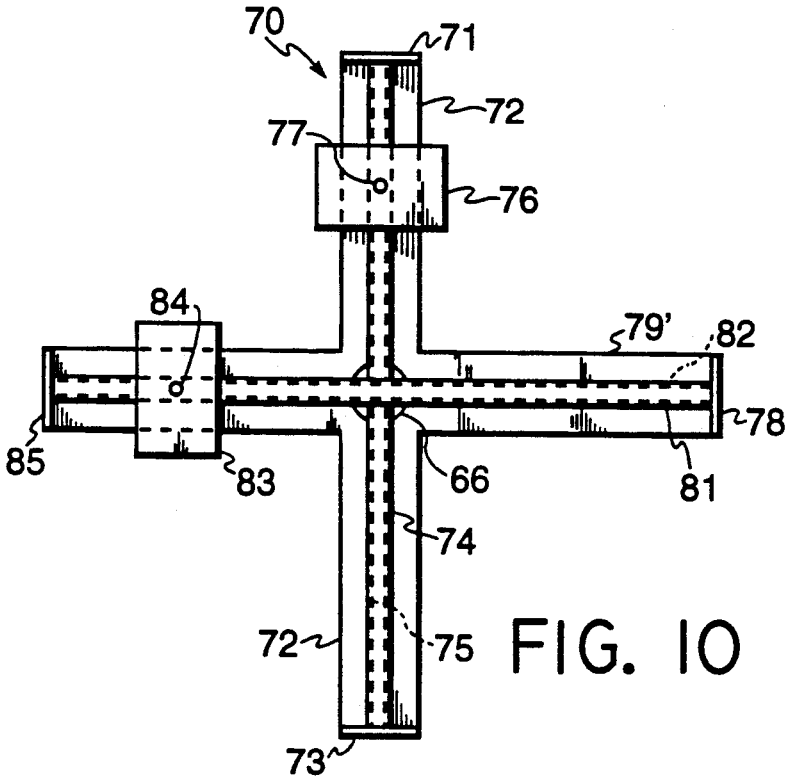
FIG. 10 is a detailed front view of a further embodiment of a torque assembly used in the present invention.
Figure 11:
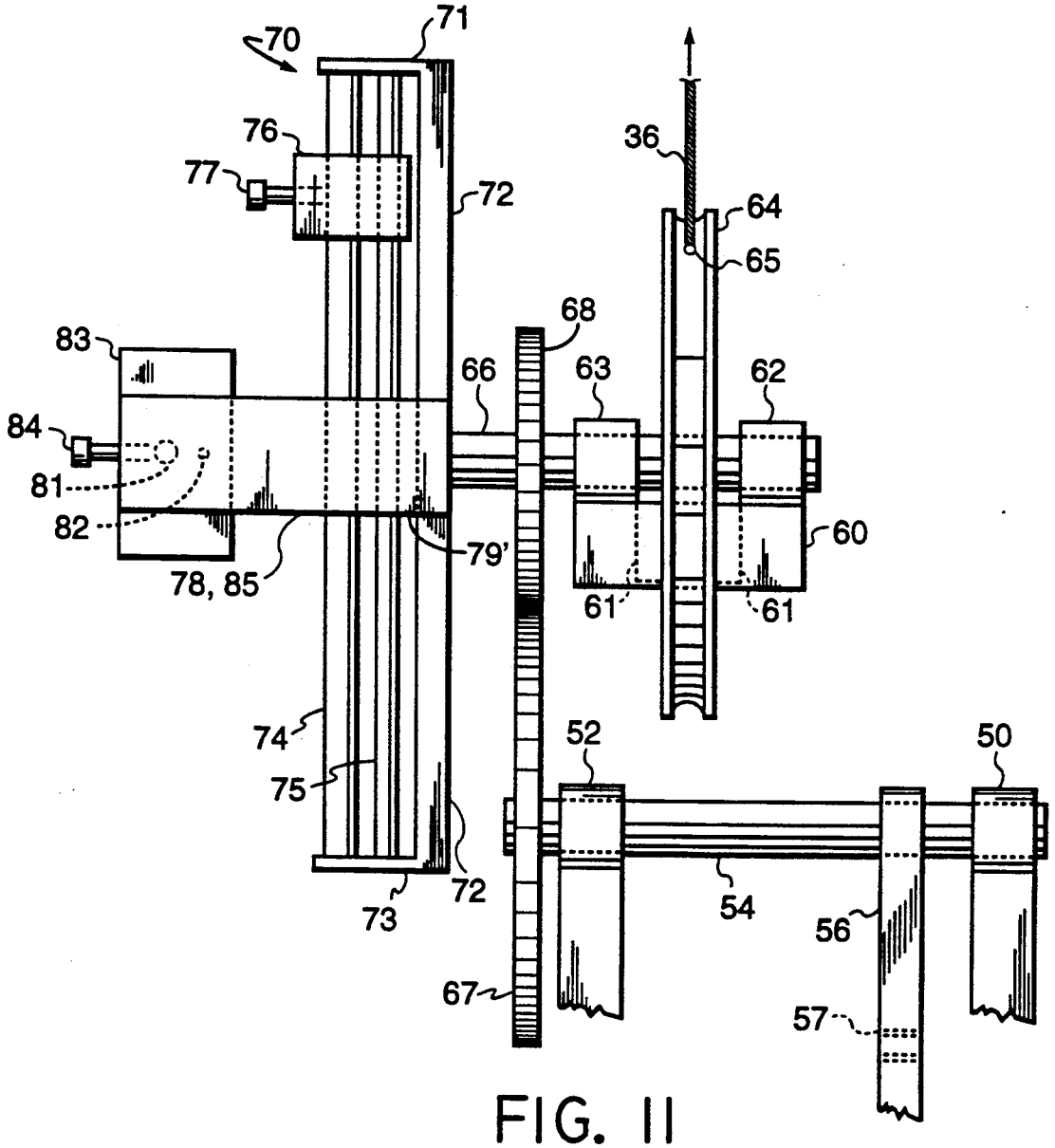
FIG. 11 is a view similar to FIG. 7 but of the further embodiment of the torque assembly shown in FIG. 10.

As stated hereinabove, it is possible for the torque arm assembly 70 to have more than one diametric torque arm, and such a construction is depicted in FIGS. 10 and 11. Those elements in FIGS. 10 and 11 which are similar to those of FIGS. 7 and 8 bear numerical references identical to those FIGURES, except where otherwise noted. In FIGS. 10 and 11, it is seen that according to a further preferred embodiment of the torque arm assembly 70, aside from the first generally vertically extending diametric torque arm 72, there is also provided a second generally horizontally extending diametric torque arm 79' which is preferably integral with arm 72 and, like arm 72, is attached at its midpoint to the outboard end of second shaft 66. Although represented in a preferred cross-shaped configuration wherein the first and second diametric torque arms 72 and 79' extend substantially transverse to one another, it is also contemplated that they may be positioned at other predetermined angles relative to one another and relative to shaft 66.

Like the earlier described embodiment of the torque arm assembly 70, the first diametric torque arm 72 of the torque arm assembly of FIGS. 10 and 11 is provided with outboard flanges 71 and 73 which carry weight support rods 74 and 75 that slidably support a weight member 76 which can be selectively fixed at any desired position therealong by pressure locking device 77. Similarly, the second diametric torque arm 79' has relatively elongated outboard flanges 78 and 85 that carry weight support rods 81 and 82 at a preselected spacing from rods 74 and 75. Rods 81 and 82, in turn, slidably support a weight member 83 which can be selectively fixed at any position along rods 81 and 82 by pressure locking device 84. Outboard flanges 78 and 85 are of sufficient length, as is most clearly shown in FIG. 11, to enable the weight members 76 and 84 to lie in spaced-apart substantially parallel planes. Accordingly, the weight member 76 is permitted completely free passage between flanges 71 and 73, and the weight member 84 is permitted completely free passage between flanges 78 and 85, whereby the weight members 76 and 83 can be selectively positioned in a virtually infinite array of positions relative to one another in order to achieve a desired resistance curve. Weight members 76 and 83 may have the same or different masses and, if desired, additional such weight members may be supported on the weight rods 74, 75, 81 and 82.

Figure 8:
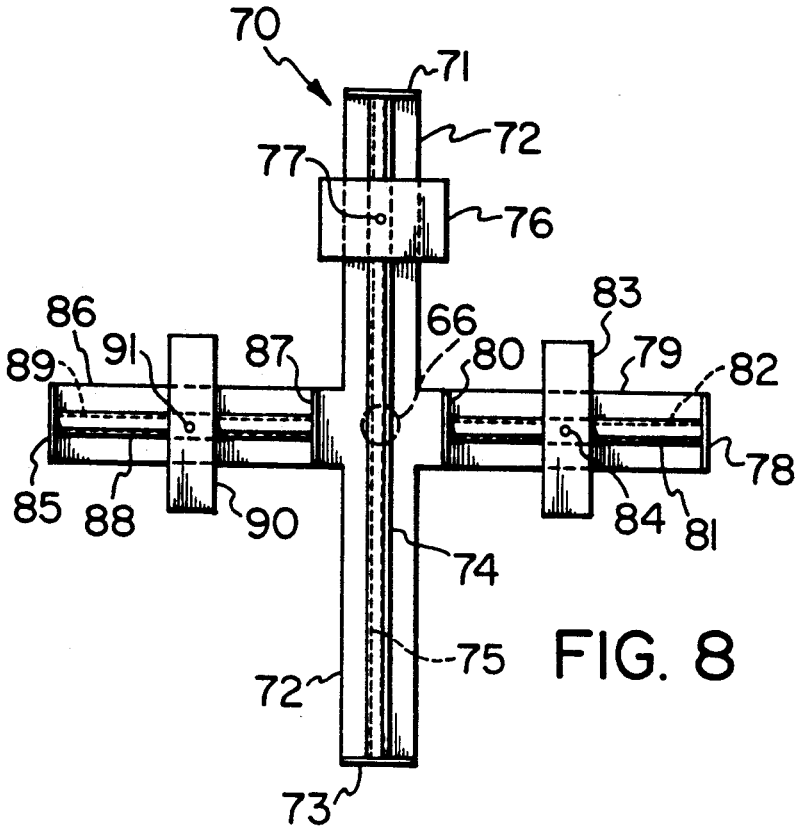
FIG. 8 is a detailed front view of a torque assembly used in the present invention.

A particular advantage of the construction of the torque arm assembly 70 shown in FIGS. 10 and 11 is that by eliminating the radial torque arms, such as the arms 79 and 86 of the torque arm assembly illustrated in FIG. 8, the requirement of the inboard flanges, e.g., flanges 80 and 87, is obviated and, therefore, the encumbrance that a separate weight member be provided on each radial torque arm in order to achieve satisfactory weight adjustability is removed. Moreover, the presence of the inboard flanges on the radial torque arms preclude the weight members supported thereon from being positioned directly in alignment with the axis of shaft 66 (or very close thereto), thereby somewhat limiting the range of available adjustability of the weight members and, hence, the range of resistance curves achievable by the torque arm assembly. Whereas, in the torque arm assembly 70 shown in FIGS. 10 and 11, the range of adjustability of the weight members is unhindered since the weight member 76 and/or the weight member 83 can be situated directly in alignment with or extremely close to the axis of shaft 66.

While a presently preferred embodiment of practicing the invention has been shown and described with particularity in connection with the accompanying drawings, the invention may be otherwise embodied within the scope of the following claims.

What is claimed is:

1. An exercise device for generating a plurality of resistance curves comprising: a support frame; a shaft rotatably supported on the support frame; a user interface member connected to the shaft which when displaced by a user causes the shaft to rotate; a resistance generator connected to the frame which generates a constant selected baseline resistance force; a transfer assembly for transferring said constant baseline resistance force from the resistance generator to the user interface member; a torque assembly for applying a torque to the shaft which can selectively vary in magnitude and direction, said torque assembly comprising a plurality of weight members supported on a plurality of torque arms secured to the shaft at predetermined angular positions such that the baseline resistance force experienced by the user during an exercise motion can be selectively varied by selected relative placement of the weight members on the torque arms.

2. The exercise device as described in claim 1 wherein the torque assembly further comprises at least three torque arms secured to the shaft at predetermined angular positions.

3. The exercise device as described in claim 2 wherein the predetermined angular position is 120°.

4. The exercise device as described in claim 2 wherein the weight members are linearly positionable on each torque arm and have the same mass.

5. The exercise device as described in claim 2 wherein the weight members are linearly positionable on each torque arm and have different masses.

6. The exercise device as described in claim 2 wherein a weight attachment means is secured to a torque arm of the torque assembly such that a weight member can be removably secured to the weight attachment means.

7. The exercise device as described in claim 6 wherein the weight attachment means is a series of pegs secured along the length of a torque arm.

8. The exercise device as described in claim 6 wherein the weight attachment means is a peg secured at the end of a torque arm.

9. The exercise device as described in claim 1 wherein the user interface member is indirectly connected to the shaft through a transfer mechanism.

10. The exercise device as described in claim 1 wherein the user interface member is connected to the shaft using at least a lever and a fulcrum.

11. The exercise device as described in claim 1 wherein the resistance generator and the transfer assembly comprise a weight support carriage vertically movable within the support frame for detachably securing at least one weight member and a cable segment secured at one end to the weight support carriage and at the other end to the user interface member.

12. The exercise device as described in claim 1 wherein the resistance generator and the transfer assembly comprise: a weight support carriage vertically movable within the support frame for detachably securing a plurality of weight members; a cable guide means supported by the support frame; a cable segment secured at one end to the weight support carriage and extending through the cable guide means; a second shaft rotatably supported on the support frame; a bearing member attached to the second shaft for engagement by a user to rotate the second shaft; and a cable receiving surface mounted on the second shaft having a circumferential arc surface with the other end of the cable segment attached to the cable receiving surface such that the rotation of the cable receiving surface causes the cable segment to engage the circumferential arc surface to transmit force to the cable segment and to the weight support carriage.

13. The exercise device as described in claim 12 further comprising: a first gear attached to the first shaft for rotation therewith and a second gear attached to the second shaft for rotation therewith, the second gear being engaged with the first gear.

14. An exercise device for generating a plurality of resistance curves comprising: a support frame; a first shaft rotatably supported on the support frame; a user interface member connected to said first shaft which when displaced by a user causes said first shaft to rotate; a resistance generator connected to the frame which generates a selected baseline resistance force; a transfer assembly for transferring said baseline resistance force from the resistance generator to the user interface member; a second shaft rotatably supported on the support frame; a torque assembly connected to one of said first and second shafts, said torque assembly comprising a plurality of weight members supported on a plurality of torque arms, said weight members being selectively positionable along said torque arms; and a conversion mechanism coupling said first and second shafts and enabling a converted variable resistance force relating to a selected pattern of variable resistance force established by selected relative positioning of said weight members along said torque arms to be transferred by said first and second shafts to said user interface member during displacement of said user interface member by said user.

15. The exercise device as described in claim 14 wherein the torque assembly further comprises at least three torque arms secured to said second shaft at predetermined angular positions.

16. The exercise device as described in claim 15 wherein the predetermined angular position is 120°.

17. The exercise device as described in claim 15 wherein the weight members are linearly positionable on each torque arm and have the same mass.

18. The exercise device as described in claim 15 wherein the weight members are linearly positionable on each torque arm and have different masses.

19. The exercise device as described in claim 15 wherein a weight attachment means is secured to a torque arm of the torque assembly such that a weight member can be removably secured to the weight attachment means.

20. The exercise device as described in claim 19 wherein the weight attachment means is a series of pegs secured along the length of a torque arm.

21. The exercise device as described in claim 19 wherein the weight attachment means is a peg secured at the end of a torque arm.

22. The exercise device as described in claim 14 wherein the user interface member is indirectly connected to said first shaft through a transfer mechanism.

23. The exercise device as described in claim 14 wherein the user interface member is indirectly connected to said second shaft through a transfer mechanism.

24. The exercise device as described in claim 14 wherein the user interface member is connected to said first shaft using at least a lever and a fulcrum.

25. The exercise device as described in claim 14 wherein the user interface member is connected to said second shaft using at least a lever and a fulcrum.

26. The exercise device as described in claim 14 wherein said torque assembly is connected to said second shaft.

27. The exercise device as described in claim 14 wherein the conversion mechanism is a set of gears.

28. The exercise device as described in claim 14 wherein the resistance generator and the transfer assembly comprise a weight support carriage vertically movable within the support frame for detachably securing at least one weight member and a cable segment secured at one end to the weight support carriage and at the other end to the user interface member.

29. An exercise device for generating a plurality of resistance curves comprising: a support frame; a shaft rotatably supported on the support frame; a user interface member connected to the shaft which when displaced by a user causes the shaft to rotate; a resistance generator connected to the frame which generates a constant selected baseline resistance force; a transfer assembly for transferring said constant baseline resistance force from the resistance generator to the user interface member; a torque assembly for applying a torque to the shaft which can selectively vary in magnitude and direction, said torque assembly comprising at least one weight member supported on at least one diametric torque arm secured to the shaft at a predetermined angular position such that the baseline resistance force experienced by the user during an exercise motion can be selectively varied by selected placement of said at least one weight member on said at least one diametric torque arm.

30. The exercise device as described in claim 29 wherein said at least one weight member is linearly positionable on said at least one diametric torque arm.

31. The exercise device as described in claim 29 wherein a weight attachment means is secured to said at least one diametric torque arm such that said at least one weight member can be removably secured to the weight attachment means.

32. The exercise device as described in claim 31 wherein the weight attachment means is a series of pegs secured along said at least one diametric torque arm.

33. The exercise device as described in claim 31 wherein the weight attachment means is a peg secured at the end of said at least one diametric torque arm.

34. The exercise device as described in claim 29 wherein the user interface member is indirectly connected to the shaft through a transfer mechanism.

35. The exercise device as described in claim 29 wherein the user interface member is connected to the shaft using at least a lever and a fulcrum.

36. The exercise device as described in claim 29 wherein the resistance generator and the transfer assembly comprise a weight support carriage vertically movable within the support frame for detachably securing at least one weight member and a cable segment secured at one end to the weight support carriage and at the other end to the user interface member.

37. The exercise device as described in claim 29 wherein the resistance generator and the transfer assembly comprise: a weight support carriage vertically movable within the support frame for detachably securing a plurality of weight members; a cable guide supported by the support frame; a cable segment secured at one end to the weight support carriage and extending through the cable guide means; a second shaft rotatably supported on the support frame; a bearing member attached to the second shaft for engagement by a user to rotate the second shaft; and a cable receiving surface mounted on the second shaft having a circumferential arc surface with the other end of the cable segment attached to the cable receiving surface such that the rotation of the cable receiving surface causes the cable segment to engage the circumferential arc surface to transmit force to the cable segment and to the weight support carriage.

38. The exercise device as described in claim 37 further comprising: a first gear attached to the first shaft for rotation therewith and a second gear attached to the second shaft for rotation therewith, the second gear being engaged with the first gear.

39. An exercise device for generating a plurality of resistance curves comprising: a support frame; a first shaft rotatably supported on the support frame; a user interface member connected to said first shaft which when displaced by a user causes said first shaft to rotate; a resistance generator connected to the frame which generates a selected baseline resistance force; a transfer assembly for transferring said baseline resistance force from the resistance generator to the user interface member; a second shaft rotatably support on the support frame; a torque assembly connected to one of said first and second shafts, said torque assembly comprising at least one weight member supported on at least one diametric torque arm, said at least one weight member being selectively positionable along said at least on diametric torque arm; and a conversion mechanism coupling said first and second shafts and enabling a converted variable resistance force relating to a selected pattern of variable resistance force established by selected relative positioning of said at least one weight member along said at least one diametric torque arm to be transferred by said first and second shafts to said user interface member during displacement of said user interface member by said user.

40. The exercise device as described in claim 39 wherein said at least one weight member is linearly positionable on said at least one diametric torque arm.

41. The exercise device as described in claim 39 wherein a weight attachment means is secured to said at least one diametric torque arm such that said at least one weight member can be removably secured to the weight attachment means.

42. The exercise device as described in claim 41 wherein the weight attachment means is a series of pegs secured along said at least one diametric torque arm.

43. The exercise device as described in claim 41 wherein the weight attachment means is a peg secured at the end of said at least on diametric torque arm.

44. The exercise device as described in claim 39 wherein the user interface member is indirectly connected to said first shaft through a transfer mechanism.

45. The exercise device as described in claim 39 wherein the user interface member is indirectly connected to said second shaft through a transfer mechanism.

46. The exercise device as described in claim 39 wherein the user interface member is connected to said first shaft using at least a lever and a fulcrum.

47. The exercise device as described in claim 39 wherein the user interface member is connected to said second shaft using at least a lever and a fulcrum.

48. The exercise device as described in claim 39 wherein said torque assembly is connected to said second shaft.

49. The exercise device as described in claim 39 wherein the conversion mechanism is a set of gears.

50. The exercise device as described in claim 39 wherein the resistance generator and the transfer assembly comprise a weight support carriage vertically movable within the support frame for detachably securing at least one weight member and a cable segment secured at one end to the weight support carriage and at the other end to the user interface member.

51. An exercise device for generating a plurality of resistance curves comprising: a support frame; a shaft rotatably supported on the support frame; a user interface member connected to the shaft which when displaced by a user causes the shaft to rotate; a resistance generator connected to the frame which generates a constant selected baseline resistance force; a transfer assembly for transferring said constant baseline resistance force from the resistance generator to the user interface member; a torque assembly for applying a torque to the shaft which can selectively vary in magnitude and direction, said torque assembly comprising a plurality of weight members supported on a plurality of diametric torque arms secured to the shaft at predetermined angular positions such that the baseline resistance force experienced by the user during an exercise motion can be selectively varied by selected relative placement of the weight members on the torque arms.

52. The exercise device as described in claim 51 wherein said diametric torque arms include means for supporting said weight members in spaced-apart substantially parallel planes.

53. The exercise device as described in claim 51 wherein said plurality of torque arms comprise first and second diametric torque arms.

54. The exercise device as described in claim 53 wherein said first diametric torque arm includes outboard flanges of a first length carrying therebetween means for supporting and adjustably positioning at least one of said weight members in a first of said planes, and wherein said second diametric torque arm includes outboard flanges of a second length carrying therebetween means for supporting and adjustably positioning at least one of said weight members in a second of said planes.

55. The exercise device as described in claim 53 wherein said first and second diametric torque arms extend substantially perpendicular to one another.

* * * * *